US010197053B2

(12) United States Patent
Jiang

(10) Patent No.: US 10,197,053 B2
(45) Date of Patent: Feb. 5, 2019

(54) TURN-BACK COAXIAL GAS PRESSURIZING PUMP AND GAS PRESSURIZING METHOD

(71) Applicant: Beijing Const Instrument Technology Inc., Beijing (CN)

(72) Inventor: Weili Jiang, Beijing (CN)

(73) Assignee: Beijing Const Instrument Technology Inc. (CN)

( * ) Notice: Subject to any disclaimer, the term of this patent is extended or adjusted under 35 U.S.C. 154(b) by 695 days.

(21) Appl. No.: 14/700,799

(22) Filed: Apr. 30, 2015

(65) Prior Publication Data

US 2015/0233362 A1 Aug. 20, 2015

Related U.S. Application Data

(63) Continuation of application No. PCT/CN2013/087512, filed on Nov. 20, 2013.

(30) Foreign Application Priority Data

Apr. 9, 2013 (CN) ..... 2013 1 0120300

(51) Int. Cl.
*F04B 53/12* (2006.01)
*F04B 25/04* (2006.01)
(Continued)

(52) U.S. Cl.
CPC ..... *F04B 53/121* (2013.01); *F04B 3/003* (2013.01); *F04B 25/005* (2013.01); *F04B 25/04* (2013.01);
(Continued)

(58) Field of Classification Search
CPC ..... F04B 3/003; F04B 3/00; F04B 53/1075; F04B 53/12; F04B 53/121; F04B 25/04;
(Continued)

(56) References Cited

U.S. PATENT DOCUMENTS 817,538 A * 4/1906 Wixon ..... F04B 3/003 417/258
885,485 A 4/1908 Kellogg
(Continued)

FOREIGN PATENT DOCUMENTS

CN 2170397 Y 6/1994
CN 101737294 A 6/2010
(Continued)

OTHER PUBLICATIONS

International Search Report for Application No. PCT/CN2013/087512 dated Feb. 20, 2014.
(Continued)

*Primary Examiner* — Bryan Lettman
(74) *Attorney, Agent, or Firm* — Lerner, David, Littenberg, Krumholz & Mentlik, LLP

(57) ABSTRACT

A turn-back coaxial gas pressurizing pump and gas pressurizing method using the same, relate to the field of gas pressure boosting. The turn-back coaxial gas pressurizing pump includes a primary cylinder, a primary piston, a secondary cylinder serving as a rod of the primary piston, a pressure bar, an air pump bonnet, a secondary piston and a piston rod. The primary cylinder, the secondary cylinder and the piston rod are arranged coaxially. A rear end of the piston rod extends through a first non-returning adaptive valve provided in the primary piston and is fixed on the bottom wall of the primary cylinder. As a result, the two pistons move in opposite directions to boost the pressure.

22 Claims, 4 Drawing Sheets

(51) Int. Cl.

| | |
|---|---|
| ***F04B 25/00*** | (2006.01) |
| ***F04B 39/10*** | (2006.01) |
| ***F04B 53/10*** | (2006.01) |
| ***F04B 39/00*** | (2006.01) |
| ***F04B 3/00*** | (2006.01) |
| ***F04B 27/00*** | (2006.01) |

(52) U.S. Cl.
CPC ..... *F04B 27/005* (2013.01); *F04B 39/0016* (2013.01); *F04B 39/10* (2013.01); *F04B 53/1075* (2013.01)

(58) Field of Classification Search
CPC ..... F04B 25/005; F04B 27/005; F04B 25/02; F04B 27/08; F04B 39/10; F04B 39/005; F04B 53/123; F04B 53/124; F04B 53/125; F04B 53/127; F04B 53/128
See application file for complete search history.

(56) References Cited

U.S. PATENT DOCUMENTS 1,166,098 A * 12/1915 Watson ..... F04B 3/003 417/258
1,187,835 A * 6/1916 Hill ..... F04B 3/00 417/248
4,149,831 A * 4/1979 Davis ..... F04B 5/02 417/251
4,239,460 A * 12/1980 Golz ..... F04B 3/003 417/251
5,676,529 A 10/1997 Hermansen et al.
6,027,316 A 2/2000 Wang
6,193,482 B1 * 2/2001 Chen ..... F04B 39/0016 417/545

FOREIGN PATENT DOCUMENTS

| | | | |
|---|---|---|---|
| CN | 202517436 | U | 11/2012 |
| CN | 103233876 | A | 8/2013 |
| CN | 203201743 | U | 9/2013 |
| JP | 2009097495 | A | 5/2009 |

OTHER PUBLICATIONS

Supplementary European Search Report for Application No. 13881536 dated Oct. 20, 2016.
Chinese Search Report for Application No. 201310120300.9 dated Sep. 7, 2015.

* cited by examiner

TURN-BACK COAXIAL GAS PRESSURIZING PUMP AND GAS PRESSURIZING METHOD

CROSS-REFERENCE TO RELATED APPLICATIONS

The present application is a continuation of International Application No. PCT/CN2013/087512, filed Nov. 20, 2013, which claims priority from Chinese Application No. 201310120300.9, filed Apr. 9, 2013, all of which are hereby incorporated herein by reference.

TECHNICAL FIELD

The present invention pertains to the area of pressure gauge calibration, and relates to a gas pressurizing apparatus used with a pressure calibration instrument. In particularly, it relates to a multistage boosting air pump and a pressurizing method with high pressurizing efficiency.

BACKGROUND OF THE INVENTION

In the area of pressure gauge calibration, a gas pressurizing pump is usually used as a pressurizing apparatus with a pressure calibration instrument. A gas pressurizing apparatus is a kind of widely used product in the area of pressure gauge calibration wherein air pumps generate required pressure by air compression, so that pollution and contamination to the environment happen in liquid pressurizing devices but hardly happen in air pumps. However, air pumps in the prior art usually employ one-stage gas compression for generating gas pressure, so that it can only reach a very low pressure depending on the compression ratio. In addition, depending on the operating forces, the gas pressurizing efficiency is so low that it will directly impact the efficiency of the pressure instrument's calibration. With the development of science and technology, bearing capacity of industrial pressure equipment has been improved, and the scale of the pressure monitoring instruments have been widened, too. Nevertheless, the pressurizing capability (value and efficiency) of air pumps applied to the calibration in the prior art is far from enough to meet the requirements of industrial development. Moreover, portable pressurizing devices are required for the on-site verification and calibration of the instrument. Therefore, it is urgently demanded for a kind of gas pressurizing apparatus which is light, easy to carry and to reach high pressure output.

SUMMARY OF THE INVENTION

The object of the present invention is to provide a simple, reliable, and efficient turn-back coaxial gas pressurizing pump, and a kind of pressurizing method efficiently.

The turn-back coaxial gas pressurizing pump in the present invention comprises: a primary cylinder (01), a primary piston (02) installed in the primary cylinder (01), a secondary cylinder (06) serving as a link of the primary piston (02), a pressure bar (35) fixed on the secondary cylinder (06), and an air pump bonnet (09) covering the open ends of the primary cylinder (01); wherein a secondary piston (08) and a piston rod (14) is provided in the secondary cylinder (06), and the primary cylinder (01), the secondary cylinder (06), and the piston rod (14) are arranged coaxially. A rear end of the piston rod (14) extends through the primary piston (02) and is fixed on the bottom of the primary cylinder (01). A first non-returning adaptive valve (03) is placed between the piston rod (14) and the primary piston (02). A primary compression chamber (31) formed by the front end of the primary piston (02) is provided in the primary cylinder (01) and communicates with external air via a non-returning intake valve (16). A secondary compression chamber (33) formed by the front end of the secondary piston (08) is provided in the secondary cylinder (06) and communicates with a pressure output gas line via non-returning air-out valve (12). The primary compression chamber (31) communicates with a transition chamber (32) formed by the end of the secondary piston (08) which is provided in the secondary cylinder (06) via the first non-returning adaptive valve (03) in one-way, and the transition chamber (32) communicates with the secondary compression chamber (33) via a second non-returning control valve in one-way.

In the turn-back coaxial gas pressurizing pump, a deep groove is fluted by the rear end of the primary piston (02), and the first non-returning adaptive valve (03) is placed in a slot (21) formed on the bottom of the deep groove. The first non-returning adaptive valve (03) comprises a non-returning valve body (23), an O-ring (24), a seal unit (26), and a threaded compression ring (22). The piston rod (14) extends through the first non-returning adaptive valve, wherein, the non-returning valve body appears as an annular-cap and includes a base, a rim connected with the base, and a threaded part. The connection portion between the base and the rim has a male cone in which semicircular grooves are fluted on its conical surface. The seal unit consists of an elastic seal ring and a wear-resistant outer ring gasket. The outer ring gasket is divided into a thick-bottom part and a thin-neck part, and the elastic seal ring hoops around the thin-neck part. The seal unit is placed in a slot formed by the base and the rim within the non-returning valve body, and the outer ring gasket abuts against the base. The threaded compression ring is screwed into the valve body across the threaded part of the non-returning valve body. The threaded compression ring contacts with the elastic seal ring and compresses the seal unit by being screwed in. The O-ring is fitted into the groove which is fluted on the front end of the non-returning valve body.

In the turn-back coaxial gas pressurizing pump, a deep recessed groove is fluted by the rear end of the secondary piston (08), and the front portion of the piston rod (14) is fitted into the deep recessed groove. The front section of the main body (41) of the piston rod (14) is a tapered section whose front end is a male cone with annular grooves on its conical surface. A one-way valve O-ring (13) is fitted into the grooves, accordingly. The rear end opening of the secondary piston (08) has a tapered ring surface (43) and matches with a rim being formed on the back face of the tapered section on the piston rod (14). A clearance, serving as a gas path, is left between the matching surfaces. Male threads are arranged at the forefront of the main body (41), in which a piston gland nut (10) is screwed. The diameter of the piston gland nut (10) is larger than the minimum diameter of the tapered ring surface of the secondary piston (08), and is smaller than the diameter of the recessed groove fluted within the secondary piston (08), so that a clearance serving as a gas path is left between the external surface of the piston gland nut (10) and the internal face of the secondary piston (08). An air channel (42) is grooved on the compressing surface of the piston gland nut (10). The secondary piston (08), together with the main body (41) of the piston rod (14), the one-way valve O-ring (13), and the piston gland nut (10), consists of the second non-returning control valve.

In the turn-back coaxial gas pressurizing pump, the piston rod (14) is hollow so as to form an exhaust path for communicating with the exhaust line. The front end of the piston rod (14) is designed into a fluting. The non-returning air-out valve (12) is provided in the fluting, and the non-returning air-out valve (12) communicates with the exhaust path built in the secondary compression chamber (33) and the piston rod (14).

In the turn-back coaxial gas pressurizing pump, a first annular notch is fluted on the contact of the front face of the primary piston (02) and the internal face of the primary cylinder (01). A first seal assembly (34) is fitted into the notch. A second annular notch is fluted on the contact of the front face of the secondary piston (08) and the internal face of the secondary cylinder (06). The second seal assembly (36) is fitted into the second annular notch. The seal unit consists of an elastic seal ring and a wear-resistant ring gasket. The seal ring has a recessed annular groove, and the elastic seal ring is placed between the annular groove and the front annular opening of the piston.

In the turn-back coaxial gas pressurizing pump, the external surfaces of the primary piston (02) and the secondary piston (08) have annular grooves respectively. Guide rings are fitted into the annular grooves.

In the turn-back coaxial gas pressurizing pump, the secondary cylinder (06) extends from an open end of the primary cylinder (01) and extends through the air pump bonnet (09) and into the fitting portion of the air pump bonnet (09) and the secondary cylinder (06). A pressure bar guide ring (11) is provided with clearance fit.

In the turn-back coaxial gas pressurizing pump, the non-returning intake valve (16) is provided in a continuous groove being fluted on the bottom wall (19) of the primary cylinder (01): The intake valve; communicates with the primary compression chamber (31) of the primary cylinder (01) at an output side, and communicates with atmosphere at an inlet.

In the turn-back coaxial gas pressurizing pump, a sealing plug (18) is provided by the end of the continuous groove which is fluted on the bottom wall (19) of the primary cylinder (01). The non-returning intake valve (16) is provided in a groove which is fluted by the front end of the sealing plug (18). Seal rings are provided in the annular groove formed on the outer cylindrical surface of the sealing plug (18), and the sealing plug (18) is threadedly connected to the continuous groove of the bottom wall (19).

The gas boosting method provided in the present invention uses the turn-back coaxial gas pressurizing means which is described above, and comprises the following steps:

Controlling a pressure bar (35) to force the secondary cylinder (06) and the primary piston (02) to move towards the suction direction of the primary cylinder (01), so as to close the first non-returning adaptive valve 03 and to open the non-returning intake valve (16) for taking air into the primary compression chamber (31), and to open the second non-returning control valve to allow the air of the transition chamber (32) to enter into the secondary compression chamber (33).

Controlling the pressure bar (35) to force the secondary cylinder (06) and the primary piston (02) to move towards an exhausting direction of the secondary cylinder (06), so as to close the non-returning intake valve (08) and to open the first non-returning adaptive valve (03) for pushing pressurized gas from the primary compression chamber (31) into the transition chamber (32), and to close the second non-returning control valve and to open the non-returning air-out valve (12) to urge the high pressure gas which is compressed in the secondary compression chamber (33) to be released to the exhaust line.

Within the above technical scheme, because it is possible to integrate pistons and a gas path control unit within a same axial in the turn-back gas pressurizing pump, so that the gas path controlling will be accomplished automatically according to the moving direction, and each part is manageable. Therefore, all of the coaxially moving parts are highly reliable. It is original from the present air pump. That fairly high gas pressure can be reached by pressurizing with a small-size pump is also pioneered in gauge calibration industry. According to the present invention, a two-stage air pressure pump is formed, so that two-stage compression can be realized in moving once, and so that gas compression is capable of reaching a higher pressure range. Gas compression efficiency is improved, while the required power for gas compression is reduced. The turn-back design ensures the product is miniaturized. The two-stage pump is a gas pressurizing apparatus suitable for instrument calibration on-site featuring on light in weight, easy to carry, and higher pressure.

In the figures: 01—primary cylinder, 02—primary piston, 03—first non-returning adaptive valve, 04—primary piston guide ring, 06—secondary cylinder, 07—secondary piston guide ring, 08—secondary piston, 09—air pump bonnet, 10—piston gland nut, 11—pressure bar guide ring, 12—non-returning air-out valve, 13—one-way valve O-ring, 14—piston rod, 16—non-returning intake valve, 18—sealing plug, 19—bottom wall of cylinder, 21—slot, 22—threaded compression ring, 23—non-returning valve body, 24—O-ring, 26—seal unit, 34—first seal assembly, 36—second seal assembly, 18—sealing plug, 31—primary compression chamber, 32—transition chamber, 33—secondary compression chamber, 35—pressure bar, 41—main body, 42—air channel, 43—tapered ring surface.

DETAILED DESCRIPTION OF THE EMBODIMENTS

The present invention is a two-stage air pressure pump developed from a conventional primary gas pressurizing pump by turning back in a coaxial direction. The two-stage pump uses a primary piston pressure bar to add parts such as a primary gas compression unit and a first non-returning adaptive valve, etc., and uses a primary piston rod as a compression cylinder secondary compression, forcing a secondary cylinder to move when a secondary piston remains relatively static. It also utilizes changes in a chamber before and after the secondary cylinder moves to carry out gas storage and gas exchange, so as to control the pressurized gas entering into the secondary compression chamber for compression or discharge. Thus, one-stage compression is changed to two-stage compression, so as to force gas to be compressed to reach an even higher pressure, the gas compression efficiency to be improved, and the required force for gas compression to be decreased. It also satisfies the development concepts of miniaturization and efficiency in modern products.

Figure 1:
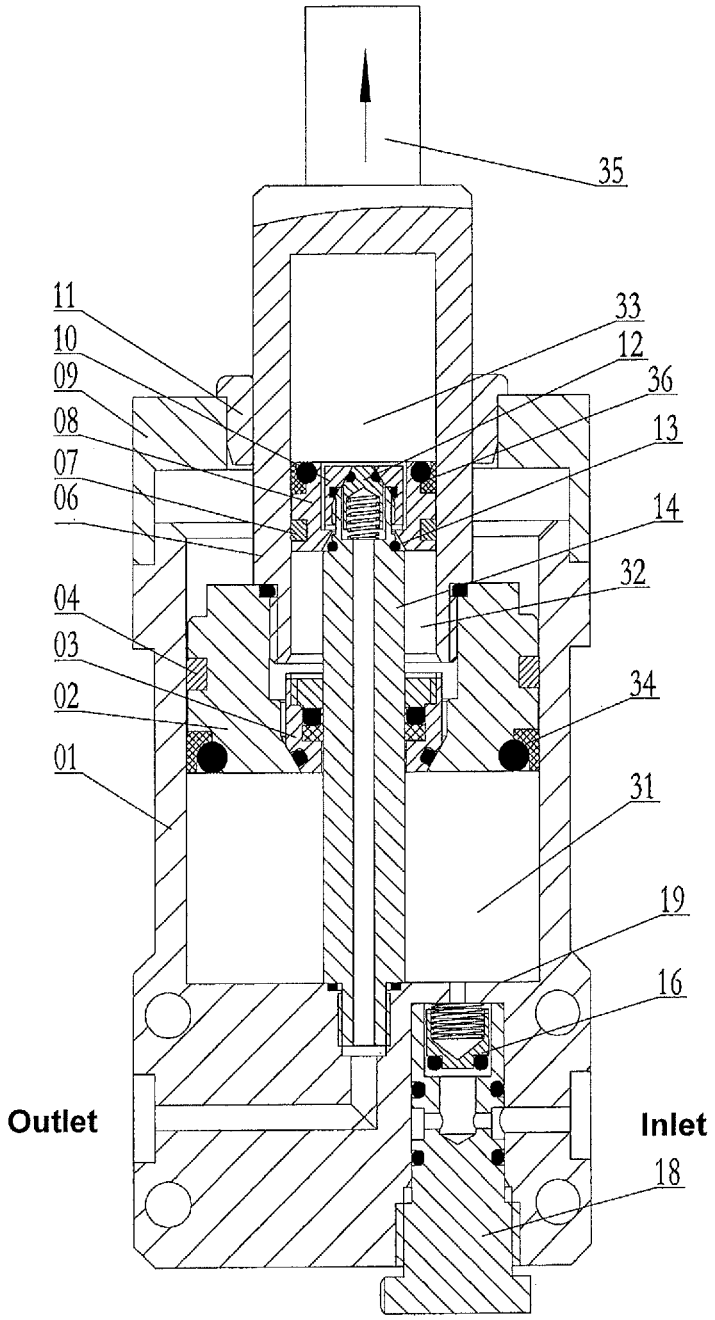
FIG. 1 is a structure diagram of the turn-back coaxial gas pressurizing pump (moving towards a suction direction).
Figure 2:
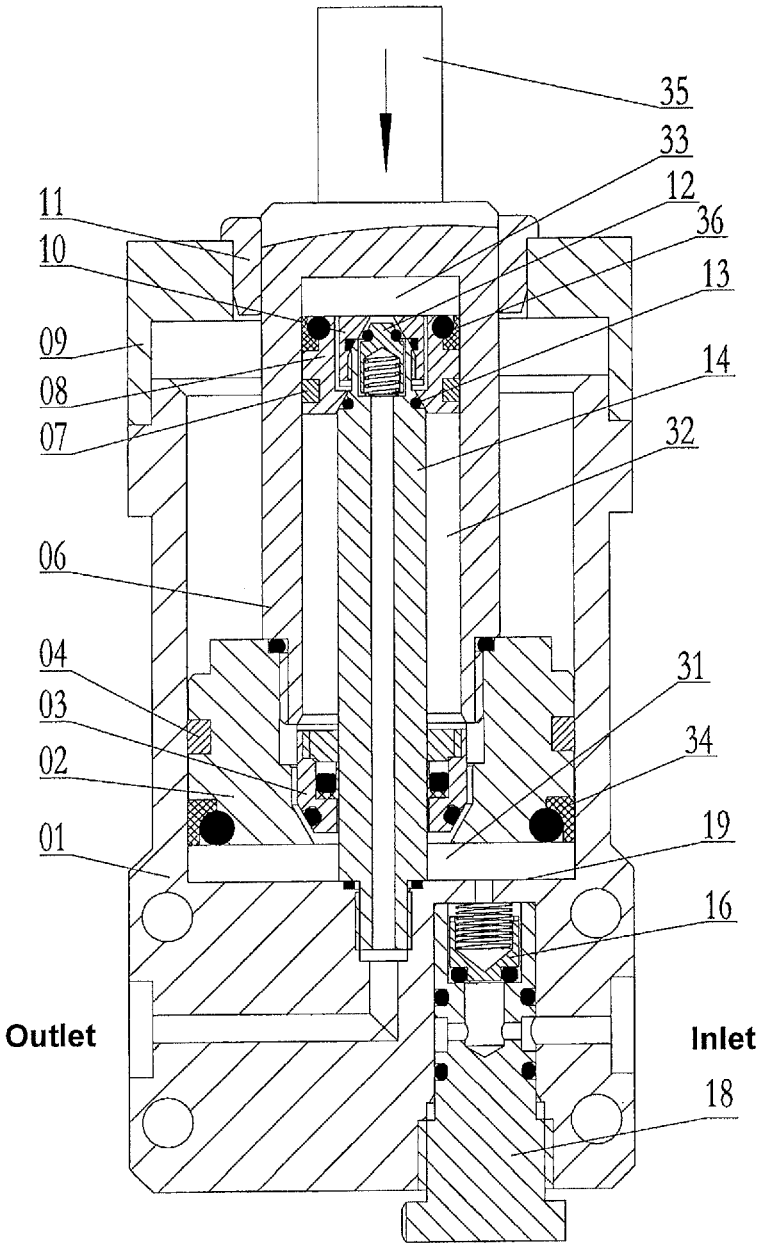
FIG. 2 is a structure diagram of the turn-back coaxial gas pressurizing pump (moving towards an exhausting direction).

The turn-back coaxial gas pressurizing pump in the present invention comprises: a primary cylinder, a primary piston, a secondary cylinder serving as a link of the primary piston, a pressure bar, an air pump bonnet, a secondary piston and a piston rod, wherein the primary cylinder, the secondary cylinder and the piston rod are arranged coaxially. A rear end of the piston rod extends through a first non-returning adaptive valve installed in the primary piston and is fixed on a bottom wall of the primary cylinder, so as to utilize the two pistons' countermove to increase the pressure. The details of the structure are shown in FIG. 1 and FIG. 2, which comprise a non-returning intake valve 16, primary cylinder 01, air pump bonnet 09, primary piston 02, secondary cylinder 06, secondary piston 08, piston rod 14, non-returning air-out valve 12, first non-returning adaptive valve 03, and second non-returning control valve, wherein:

The primary cylinder 01 acts as both a cylinder and a casing of the air pump, and integrates all parts and all gas paths relating to the air pump.

Figure 3:
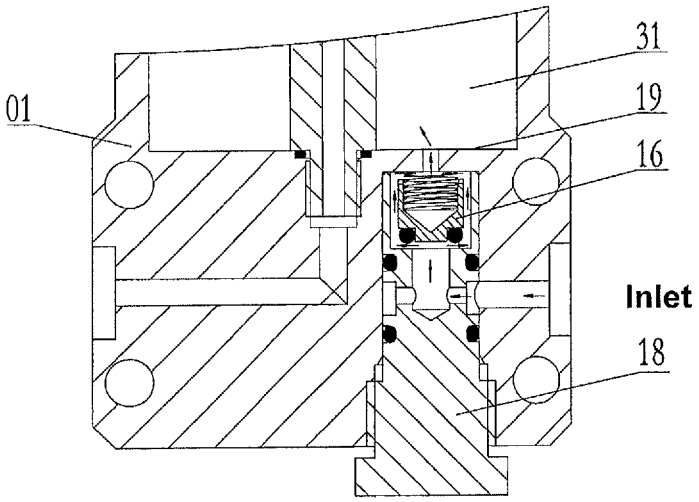
FIG. 3 is a diagram illustrating the structure of an intake side and a gas flow in suction.

The side of the cylinder bottom wall 19 acts as intake side, in which a non-returning intake valve 16 is mounted. As shown in FIG. 3, the arrow in the figure indicates the gas flow direction. The non-returning intake valve 16 is mounted in a continuous groove formed on the bottom wall 19 of the primary cylinder 01. An output side of the intake valve 16 communicates with a chamber (primary compression chamber 31) of the primary cylinder 01, and an inlet communicates with the atmosphere, to control the gas being imputed from the atmosphere into the primary cylinder 01 in one-way. For the sake of improving the overall sealing effects and facilitating the maintenance of the air pump, a sealing plug 18 is provided at an outermost end of the continuous groove on the bottom wall 19 of the cylinder. The non-returning intake valve 16 is mounted in a groove on a front end of the sealing plug 18. The sealing plug 18 together with seal rings fitted in annular grooves on an outer cylindrical surface is screwed into the continuous groove on the bottom wall 19 of the cylinder, so as to accomplish intake path assignment and installation of the one-way valve in the air pump. According to this structure, the installation of the non-returning intake valve 16 is simplified, and the maintenance and gas path arrangement of the air pump are facilitated.

The primary piston 02 is arranged in the primary cylinder 01, whose side walls are fitted with an internal face of the primary cylinder 01, whose front end is mounted with a first seal assembly 34, and a primary piston guide ring 04 serving as a guide part for the primary piston 02 and is hooped thereabout, so that two annular surfaces for positioning and guiding are formed on the primary piston 02, and clearance between the primary cylinder body 01 and the primary piston 02 can be enlarged as needed. The first seal assembly 34 consists of an elastic seal ring and a wear-resistant ring gasket, wherein the seal ring has a recessed annular groove. The elastic seal ring is fitted between the annular groove and the front annular opening of the primary piston 02, so as to keep the sealed condition between the primary piston 02 and the primary cylinder 01 with the first seal assembly 34.

The rear end of the primary piston 02 is fixed with a piston rod. In the present invention, the link of the primary piston 02 is the secondary cylinder 06, which is inserted into the primary cylinder 01 from its rear end. Threads on the external walls of the secondary cylinder 06 are tightened into the deep grooves on a rear portion of the primary piston 2, and seal rings are hooped around the joint (see also FIG. 5).

The front end of the primary piston 02 together with the bottom wall and the side walls of the primary cylinder 01 forms a primary compression chamber 31, which communicates with the non-returning intake valve 16.

The external walls of the secondary cylinder 06 act as a link whose end is protruding into the primary cylinder 01 (defined as the front end of the secondary cylinder 06) out of the primary piston 02 into the primary cylinder 01. The protruding end is connected with a pressure bar 35. The secondary cylinder 06 is driven to move by the pressure bar 35.

The rearmost section of the primary cylinder 01 is connected with the air pump bonnet 09. A pressure bar guide ring 11 acted as a forced guiding part is added on the fitting portion of the air pump bonnet 09 and the secondary cylinder 06. The pressure bar guide ring 11 serving as a main guiding part with wear resistance is required for accurate clearance fit with the secondary cylinder 06 to ensure the secondary cylinder 06 moves steadily.

The main components and assembly of the primary cylinder 01 is described above. Hereinafter, the composition of the secondary cylinder 06 is described in detail.

The secondary piston 08 is fitted in the secondary cylinder 06, and the side walls of the secondary piston 08 are fitted with the internal face of the secondary cylinder 06. Similarly, a second seal assembly 36 is put on the front end (front end direction of the secondary cylinder 06) of the secondary piston 08, and a secondary piston guide ring 07 is hooped around serving as a guiding part of the secondary piston 08, so that the secondary piston 08 is positioned and guided by two annular surfaces, and the clearance between the secondary cylinder body 08 and the secondary piston 08 could be enlarged as needed. The second seal assembly 36 consists of an elastic seal ring and a wear-resistant ring gasket. The seal ring has a recessed annular groove, and the elastic seal ring is fitted between the annular groove and the front annular opening of the secondary piston 06, so that the part between secondary piston 08 and the secondary cylinder 06 remains sealed by the second seal assembly 36.

The end of the secondary piston 08 is fixed on a piston rod 14. The piston rod 14 uses its front end to fit into the groove which is fluted on the secondary piston 08, and uses its rear end to extend from the rear end of the secondary cylinder 06 and run through the primary piston 02 until it enters into the groove arranged on the bottom wall 19 of the primary cylinder 01, and fixes them by threaded connection (the piston rod 14 is fixed, while the secondary cylinder moving in opposite direction). A seal ring is hooped around the joint which lies between the piston rod 14 and the bottom wall 19 of the primary cylinder 01. The primary cylinder 01, the secondary cylinder 06, and the piston rod 14 are arranged coaxially. A one-way valve O-ring 13 is hooped around the joint of the piston rod 14 and the rear end of the secondary piston 08. A space enclosed by the rear end of the secondary piston 08, the external face of the piston rod 14, and the rear end and the side walls of the secondary cylinder body 06 is defined as a transition chamber 32, and a space enclosed by the front end of the secondary piston 08. The front end and the side walls of the secondary cylinder body 06 is defined as a secondary compression chamber 33.

Figure 6:
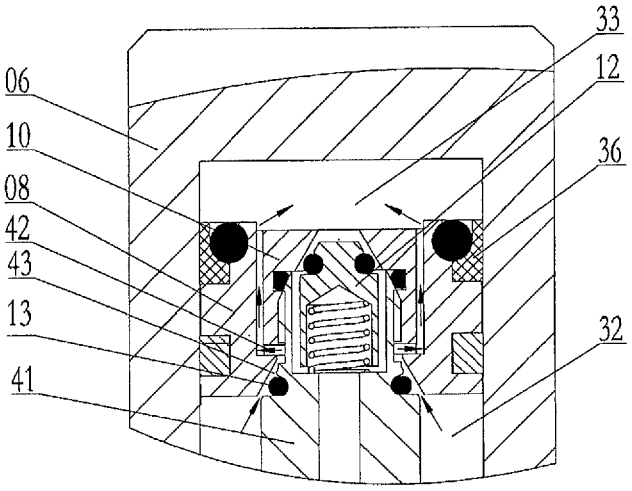
FIG. 6 is a schematic diagram illustrating the structure of a second non-returning control valve and fit in working condition.

As shown in the FIG. 6, the front end of the piston rod 14 is fitted in the recessed groove which is fluted on the secondary piston 08. The structure and the fitting relations with the secondary cylinder 06 of the secondary piston 08 are shown in FIG. 6. In this Figure, the arrows indicate the gas flow direction. The front section of the main body 41 of the piston rod 41 is a tapered section whose front end forms a male cone with annular grooves on its conical surface, and the one-way valve O-ring 13 is fitting into the groove. Accordingly, the rear end opening of the secondary piston 08 has a tapered ring surface 43, which matches with the rim being formed on the back face of the tapered section on the piston rod 14. A clearance (serving as a gas path) is reserved between the matching surfaces. The front end of the main body 41 is designed into a fluting (a non-returning air-out valve 12 is provided in the fluting). The fluting has male threads, on which a piston gland nut 10 is screwed, and a seal ring is provided on the foot of the threads of the piston gland nut 10. The internal/external gas path(s) between the piston gland nut 10 and the main body 41 will be isolated and sealed once the threads tightened up. The diameter of the piston gland nut 10 is larger than the minimum diameter of the tapered ring surface of the secondary piston 08, and is smaller than the diameter of the recessed groove fluted within the secondary piston 08, so that a clearance serving as a gas path is left between the external surface of the piston gland nut 10 and the internal face of the secondary piston 08. An air channel 42 is grooved on the compressing surface of the piston gland nut 10 (the lower end surface shown in FIG. 6). The secondary piston 08, the piston gland nut 10, the front end of the piston rod 14 and the non-returning air-out valve 12 therein are tightly fitted on the internal wall of the secondary cylinder 06. And an annular notch is fluted on the contact of the front face of the secondary piston 08 and the internal face of the secondary cylinder 06, and a second seal assembly 36 fitted into the notch.

The secondary cylinder 06 is forced to move back and forth in the axial direction in operation; so that the secondary piston 08 placed in the secondary cylinder 06 can move back and forth relatively in the secondary cylinder 06. In particular, once the secondary cylinder 06 begins to move forward (as indicated by the arrows in FIG. 2), the conical front face of the main body 41 of the piston rod 14 and the tapered ring internal surface 43 of the secondary piston 08 will be tightly fitted with each other because of the friction force between the secondary piston 08 and the secondary cylinder 06. At the same time, the one-way valve O-ring 13 is compressed. When the gas pressure in the secondary compression chamber disappears, the axial pressure of the piston rod 14 will be equal to the friction force between the secondary piston 08 and the secondary cylinder 06, so that a sealed state will occur on the matching portion between the conical front face of the piston rod 14 and the secondary piston 08, and the gas flowing from the transition chamber 32 to the secondary compression chamber is cut off. And when the secondary cylinder 06 begins to move backward (as indicated by the arrows in FIG. 1), the secondary piston 08 will be driven to move backward for a giving distance. Since the piston rod 14 and the piston gland nut 10 is screwed onto the piston rod 14 and are fixed, the piston gland nut 10 will compress the rim of the end face (lower end face) to depress the smallest end of the tapered ring surface 43 of the secondary piston 08 moving backward, so as to force the conical front surface of the piston rod 14 to uncouple with the internal conical surface of the secondary piston 08 and to form clearance therein. And the one-way valve O-ring 13 in the groove of the front conical face also uncouple with the conical sealing surface. Clearance is formed because of the rigid contact between the secondary piston 08 and the piston gland nut 10. Thus, the gas will flow into the secondary compression chamber 33 from the transition chamber 32 through the clearance between the front conical face of the piston rod 14 and the matching internal conical surface 43 of the secondary piston 08, the radial groove 42 fluted on the lower end of the piston gland nut 10, and the clearance between the piston gland nut 10 and the secondary piston 08. In this operating process, when the secondary cylinder reciprocates, the stationary piston rod 14 and piston gland nut 10 will control the slaved secondary piston 08 to move within an appropriate range until it reaches an inhibiting position (one of the two pressing positions of the tapered ring surface 43 of the secondary piston 08 and the lower end of the piston gland nut 10), so that it can act as a one-way valve to allow the gas to enter into the secondary compression chamber 33 from the transition chamber 32. The unidirectional gas moving process is indicated by the arrows in FIG. 6.

Figure 4:
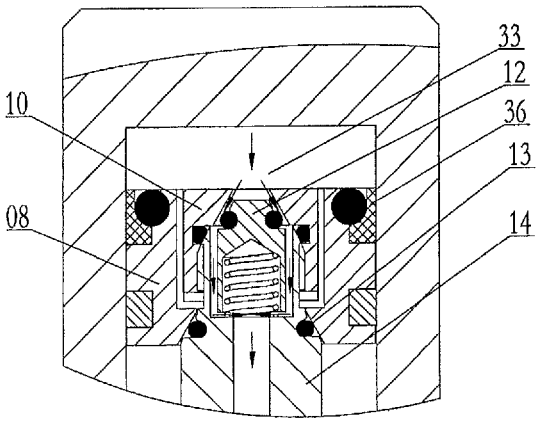
FIG. 4 is a schematic diagram illustrating the structure of an output side and the gas flow in exhaust.

Moreover, also see in FIG. 1, FIG. 2, and FIG. 4, the piston rod 14 is designed to be a hollow structure. A hollow exhaust path leads to the bottom wall 19 of the primary cylinder 01, and extends from the bottom wall 19 to the gas discharging port and then entering into an exhaust line. Another section of the exhaust path communicates with the non-returning air-out valve 12 mounted in the fluting which lies on the front end of the main body 41. The non-returning air-out valve 12 communicates with the secondary compression chamber 33 and controls the gas in the secondary compression chamber 33 to enter into the exhaust path in one-way.

The detail of the assembly of components related to the secondary cylinder had been described above. Hereinafter, joining between the primary cylinder 01 and the secondary cylinder 06 will be further described in detail.

Figure 5:
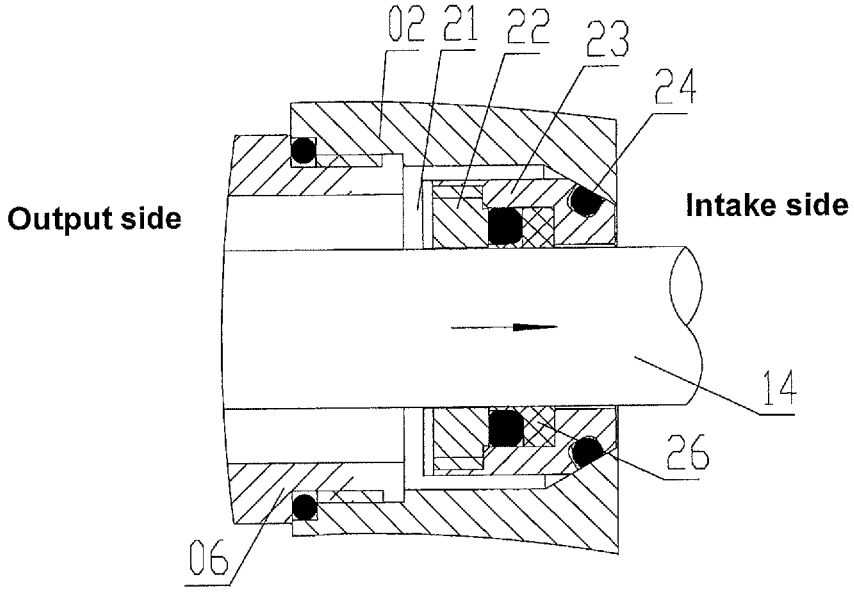
FIG. 5 is a schematic diagram illustrating the structure of a first non-returning adaptive valve and fit in working condition.

A first non-returning adaptive valve 03 is placed on a section which lies between the rear end face of the piston rod 14 extending from the secondary cylinder 06 and the front face of the primary piston 02. As shown in FIG. 5, the first non-returning adaptive valve 03 comprises: a non-returning valve body 23, an O-ring 24, a seal unit 26, and a threaded compression ring 22. The servo valve 03 extends through the piston rod 14 to be placed in a matching slot 21 arranged at the front end of the primary piston 02. Wherein, the non-returning valve body 23 appears as an annular-cap and includes a base, a rim connected with the base, and a threaded part. The front end of the connecting portion between the base and the rim has a male cone, in which a semicircular groove is fluted on its conical surface. The seal unit 26 consists of an elastic seal ring and a wear-resistant outer ring gasket, the outer ring gasket is divided into a thick-bottom part and a thin-neck part, and the elastic seal ring hoops around the thin-neck part, so that the elastic seal ring and the outer wear-resistant ring gasket are combined into one whole. The seal unit 26 is placed in a slot formed by the base and the rim within the non-returning valve body 23 in a passage of the outer ring gasket abutting against the base and cannot be reversed. A threaded compression ring 22 is screwed into the valve body 23 across a threaded part of the non-returning valve body 23. The threaded compression ring 22 contacts the elastic seal ring and compresses the seal unit 26 by threaded connection. The O-ring 24 is fitted into the groove which is placed on the front end of the non-returning valve body 23. Each of the components is assembled as above forms the structure of the first non-returning adaptive valve 03.

The first non-returning adaptive valve 03 is placed on the piston rod 14 and fitted into a slot 21 of the lowermost of the deep groove which is fluted on the primary piston 02 during use. The center hole of the first non-returning adaptive valve 03 is punctured from the side (output side) with seal unit 26. On the other hand, the slot 21 which is fluted on the bottom of the deep groove of the primary piston 02 is the same shape as the first non-returning adaptive valve 03, but is slightly larger than the latter in size of its periphery. The internal face of the lowermost bottom (intake side) of the deep groove is designed into a conical fitting surface for matching with the outer conical surface of the front end of the non-returning valve body 23. When the first non-returning adaptive valve 03 moves along with the primary piston 02 in an axial direction, it will move in relation to the internal face of the slot 21 of the deep groove on the primary piston 02 in the axial direction, so that the outer conical surface of the front end of the non-returning valve body 23 will press on the conical fitting surface of the slot 21 of the deep groove to isolate from the gas (as shown in FIG. 1), or separate from the conical fitting surface to allow the gas to flow through (as shown in FIG. 2). The secondary cylinder 06 is screwed into the rear end of the deep groove which is fluted on the primary piston 02 to act as a link of the primary piston, and the internal diameter of the secondary cylinder 06 is smaller than the external diameter of the first non-returning adaptive valve 03. With the first non-returning adaptive valve 03 in its rear end being limited by the front face of the secondary cylinder 06, and in its front end being limited by the conical surface of the primary piston 02, the first non-returning adaptive valve 03 is confined to move within an appropriate range in the axial direction. When the first non-returning adaptive valve 03 moves along with the primary piston 02 in the axial direction, the first non-returning adaptive valve 03 is driven by the friction force which generates from the sealing portion of the outer ring gasket of the seal unit 26 and the piston rod 14 to move within the confined range. When the primary piston 02 moves in the axial direction, it drives the O-ring 24 arranged on the outer conical surface of the first non-returning adaptive valve 03 to be able to press against or separate from the conical fitting surface of the internal face of the slot 21 of the deep groove on the primary piston 02, so that the force and movements can be transferred between outer ring gasket and the piston rod 14, and the functions of the first non-returning adaptive valve 03 is also realized. Thus, the function of the first non-returning adaptive valve 03 is to enable the gas in the primary compression chamber 31 to enter into the transition chamber 32 in one-way.

To assemble the components described above, it can be realized the turn-back coaxial gas pressurizing pump in the present invention.

In the structure of the air pump, the space between the secondary cylinder 06 (i.e., pressure rod) and the primary piston 02 is sealed by a seal ring to form a sealed gas transition chamber 32. The conical surface of the non-returning adaptive valve 03 is coordinated with the conical surface of the primary piston 02 to control the on/off the gas flow into the primary compression chamber 31. On the other hand, since a two-stage piston turn-back layout is used, the guiding performance is not enough. Therefore, an axial guiding unit should be used, specifically, the primary piston guide ring 04, which serves as a guiding part for the primary piston 02, and the secondary piston seal ring 07, which serves as a guiding part for the secondary piston. To ensure the pressure bar 35 and the secondary cylinder 06 moves steadily, a pressure bar guide ring 11 acts as a forced guiding part is provided on the fitting portion of the air pump bonnet 09 and the secondary cylinder 06, and as a main guiding part with wear resistance, it is required for accurate clearance fit.

An embodiment of the turn-back coaxial gas pressurizing pump is shown in FIG. 1 and FIG. 2.

As shown in FIG. 1, when the pressure bar 35 drives the secondary cylinder 06 and the primary piston 02 that it fixes together, moves towards the suction direction of the primary piston (the direction indicated by the arrows on the pressure bar 35 in FIG. 1), because of the friction force existed between the non-returning adaptive valve 03 and the piston rod 14, the non-returning adaptive valve 03 remaining stationary, and the matching conical surface of the slot 21 belonging to the primary piston 02 will continue pressing the O-ring 24 until it deforms, so as to form a seal in the non-returning adaptive valve 03. And while the primary piston 02 moves further (the non-returning adaptive valve 03 moves together at that time), the gas storage volume of the primary compression chamber 31 continues to enlarge, and the gas pressure in the chamber continues to decrease, until the gas pressure is relieved to a value that is enough for the external air pressure to overcome the spring pressure coming from the non-returning intake valve 16. Then the non-returning intake valve 16 opens, and the gas enters into the primary compression chamber 31 from the inlet via the non-returning intake valve 16. As the intake action continues, the gas will be filled into the primary compression chamber 31 accordingly, until the primary piston 02 stops moving in order to accomplish an intake cycle.

In the intake cycle, there is no relative movement between the secondary piston 08 and the secondary cylinder 06 instead of the secondary piston 08 moving along with the secondary cylinder 06 in early stages, because of the friction between them. The secondary piston 08, the piston rod 14, the piston gland nut 10, and the seal ring 13 coordinate to form a second non-returning control valve to control the flow of gas in the transition chamber 32 and the secondary compression chamber 33. Once the slaved secondary piston 08 comes into contact with the piston gland nut 10, the secondary piston 08 stops, and the sealing effect of the seal ring 13 at the fitting portion of the secondary piston 08 and the conical surface of the piston rod 14 is removed, so as to force gas in the transition chamber 32 to be dispersed from the clearance fit between the secondary piston 08 and the conical surface of the piston rod 14, the radial groove 42 on the lower end face of the piston gland nut 10, and the clearance between the external wall of the piston gland nut 10 and the internal wall of the secondary piston into the secondary compression chamber 33. Once the pressurized gas in the transition chamber 32 flows into the secondary compression chamber 33, the delivery of the pressurized gas will be accomplished. Thus, the entire intake process of the air pump is completed, i.e., the primary cylinder 01 takes gas in from the environment via the non-returning intake valve 16, while the gas in the transition chamber 32 enters into the secondary compression chamber 33.

The gas flow of the air pump in a suction state is described above. In the intake process, if the gas pressure in the secondary compression chamber 33 of the air pump is higher than the gas pressure in the external gas pipe, the non-returning air-out valve 12 will be opened, and the gas is delivered through the hollow passage in the piston rod 14 to the gas discharging port to be directly delivered into the gas output pipeline. If the gas pressure in the secondary compression chamber 33 is lower than the gas pressure in the external gas pipe, the gas will not be delivered into the external gas pipe until the gas compression pressure in the secondary compression chamber 33 is boosted up by the movement of the piston.

As shown in FIG. 2, when the movement system of the primary piston 02 and the primary cylinder 01 moves towards the exhausting direction (the direction indicated by the arrows on the pressure bar 35 in FIG. 2), the primary piston 02 along with the pressure bar 35 and the secondary cylinder 06 moves forward to compress the gas in the primary compression chamber 31, and the non-returning intake valve 16 remains closed under the spring pressure. Then, the non-returning adaptive valve 03 separates from the primary piston 02, the one-way valve O-ring 13 opens, and the compressed gas in the primary compression chamber 31 is delivered to the transition chamber 32. At that time, the secondary cylinder 06 also moves towards the gas compression direction (downward, as indicated by the arrows in FIG. 2). Because of the secondary piston 08 keeping relatively stationary, the volume of the secondary compression chamber 33 is decreased and the volume of the transition chamber 32 is increased, so that the gas pressure in the secondary compression chamber 33 is increased. Because of the friction force generated by the relative movement between the secondary piston 08 and the secondary cylinder 06, the second non-returning control valve formed by the coordination of the secondary piston 08, piston rod 14, piston gland nut 10, and one-way valve O-ring 13 urges the cone fit between the secondary piston 08 and the piston rod 14 to be compressed with their moving, so as to compress the one-way valve O-ring 13 on the sealing surface and to force the second non-returning control valve to be closed. Meanwhile, because of the secondary piston 08, the piston rod 14, and the piston gland nut 10 keeping stationary, the gas path between the transition chamber 32 and the secondary compression chamber 33 is cut off by the second non-returning control valve. With the proceeding of the movement of the secondary cylinder 06, the volume of the secondary compression chamber 33 is decreased and the gas pressure therein is increased, and the higher the gas pressure in the secondary compression chamber 33, the better the sealability of the second non-returning control valve. Once the gas pressure in the secondary compression chamber 33 is higher than the gas pressure in the connecting pipe, the non-returning air-out valve 12 is opened, and the gas is delivered through the hollow passage in the secondary piston rod 14 to the gas discharging port, so as to be delivered into the output pipeline to accomplish an exhaust cycle. In this process, the gas in the primary compression chamber 31 is pressurized and then discharged into the transition chamber 32, and the gas in the secondary compression chamber 33 is pressurized and then discharged into the output system.

An intake cycle and an exhaust cycle described above constitute a working cycle of the air pump, and by use of the primary and the secondary cylinders in a turn-back arrangement with the non-returning adaptive valve, the movement and the control of the gas path of the pistons in two stages are able to be realized coaxially. Moreover, because the primary suction and compression, transitional storage, pressurized (secondary) suction, secondary compression and discharging procedures of primary or secondary gas are realized by changing the direction of relative movement, high pressure compressed gas can be expected.

The innovative features of the present invention include:

1. Because pistons are installed with two stages in a turn-back arrangement in a coaxial system, pressurized force is obtained in a single operation, the system structure is simple, and the axial footprint of the system is small.

2. Because a secondary cylinder is utilized as a link of the primary piston, it is capable of taking full advantage of an element, i.e., an element is able to be used for accomplishing several functions, so that the structure will be simplified.

3. With using of non-returning adaptive valve, the internal gas path can be controlled reliably, and the friction force between parts is decreased gradually by the wear-in of elements.

4. With the compact seal structure of the pistons, the wearing resistance of the pressurizing unit and the high pressure unit is improved, and self-compensation is provided, so that the service life of the entire machine is increased.

5. With the use of pistons in different diameters, adjusting compression ratio appropriately is available; it is possible to reach high gas pressure or a lower operating force, and to improve gas pressurizing efficiency.

6. Since the pistons are installed coaxially and integrated with two non-returning adaptive valves by a link, less occupation and smaller components are available, the complexity of processing can be reduced, and the cost of manufacture can be reduced.

7. With the elements being installed coaxially and the guiding parts annexed in the primary and secondary pistons, eccentric wearing of the pistons and cylinders can be alleviated, and since only one pressure bar is applied in guiding, the overall stability of the air pump is improved, and the assembly is simplified.

INDUSTRIAL APPLICABILITY

The turn-back gas pressurizing pump in the present invention can build a high gas pressure only by applying force in a small volume, and its turn-back design enables the product to be reduced in size. The pump in the present invention is a gas pressurizing apparatus being light weight, easy to carry, and higher in pressure and suitable for instrument calibration on-site. So it is useful in industrial application.

The invention claimed is:

1. A turn-back coaxial gas pressurizing pump comprising, a primary cylinder, a primary piston provided in the primary cylinder, a secondary cylinder serving as a rod of the primary piston, a pressure bar fixed to the secondary cylinder, and an air pump bonnet covering an open end of the primary cylinder;

wherein a secondary piston and a piston rod are provided in the secondary cylinder, and the primary cylinder, the secondary cylinder, and the piston rod arranged coaxially, a rear end of the piston rod extends through the primary piston and is fixed on a bottom of the primary cylinder, a first non-returning adaptive valve is placed between the piston rod and the primary piston, a primary compression chamber formed by a front end of the primary piston is provided in the primary cylinder and communicates with external air via a non-returning intake valve, a secondary compression chamber formed by a front end of the secondary piston is provided in the secondary cylinder and communicates with a pressure output gas line via a non-returning air out valve, the primary compression chamber communicates with a transition chamber formed by a rear end of the secondary piston which is provided in the secondary cylinder via the first non-returning adaptive valve in a one-way manner, and the transition chamber communicates with the secondary compression chamber via a second non-returning control valve in a one-way manner, wherein, a groove is fluted by a rear end of the primary piston, and the first non-returning adaptive valve is placed in a slot formed on a bottom of the groove, the first non-returning adaptive valve comprising: a non-returning valve body, an O-ring, a seal unit, and a threaded compression ring, the piston rod extends through the first non-returning adaptive valve, wherein, the non-returning valve body appears as an annular-cap and includes a base, a rim connected with the base, and a threaded part, a connection portion between the base and the rim has a male cone, wherein semicircular grooves are fluted on its conical surface, the seal unit consists of an elastic seal ring and a wear-resistant outer ring gasket, the outer ring gasket is divided into a thick-bottom part and a thin-neck part, and the elastic seal ring hoops around the thin-neck part, the seal unit is placed in a slot formed by the base and the rim within the non-returning valve body, and the outer ring gasket abuts against the base, the threaded compression ring is screwed into the valve body across the threaded part of the non-returning valve body, the threaded compression ring contacts with the elastic seal ring and compresses the seal unit by its being screwed in, the O-ring is fitted into the groove which is fluted on the front end of the non-returning valve body.

2. The turn-back coaxial gas pressurizing pump according to claim 1, wherein external surfaces of the primary piston and the secondary piston have annular grooves respectively, and guide rings are fitted into the annular grooves.

3. The turn-back coaxial gas pressurizing pump according to claim 1, wherein; the secondary cylinder extends from an open end of the primary cylinder and extends through the air pump bonnet, and a pressure bar guide ring is provided in clearance fit with a fitting portion between the air pump bonnet and the secondary cylinder.

4. The turn-back coaxial gas pressurizing pump according to claim 1, wherein; the non-returning intake valve is provided in a continuous groove placed on a bottom wall of the primary cylinder, an output side of the non-returning intake valve communicates with the primary compression chamber of the primary cylinder, and an intake side of the non-returning intake valve communicates with atmosphere.

5. The turn-back coaxial gas pressurizing pump according to claim 4, wherein, a sealing plug is provided at the end of the continuous groove on the bottom wall of the primary cylinder, the non-returning intake valve is provided in a groove fluted on a front end of the sealing plug, a plurality of seal rings are provided in the annular groove on an outer cylindrical surface of the sealing plug, and the sealing plug is screwed to the continuous groove on the bottom wall.

6. A gas pressurizing method, which uses the turn-back coaxial gas pressurizing pump as set forth in claim 1, comprising the following steps:

controlling the pressure bar to drive the secondary cylinder and the primary piston to move towards a gas suction direction of the primary cylinder, so that the first non-returning adaptive valve is closed and the non-returning intake valve is opened to take air into the primary compression chamber, and the second non-returning control valve is opened to allow the gas in the transition chamber to enter into the secondary compression chamber, and controlling the pressure bar to drive the secondary cylinder and primary piston to move towards a gas discharging direction of the secondary cylinder, so that the non-returning intake valve is closed and the first non-returning adaptive valve is opened to discharge pressurized gas from the primary compression chamber into the transition chamber, and at the same time the second non-returning control valve is closed, the non-returning air-out valve is opened, and the compressed high pressure gas in the secondary compression chamber is discharged into the pressure output gas line.

7. The turn-back coaxial gas pressurizing pump according to claim 1, wherein, a recessed groove is fluted by the rear end of the secondary piston, and a front portion of the piston rod is fitted into the recessed groove, a front section of a main body of the piston rod is a tapered section whose front end is a male cone with annular grooves on its conical surface, a one-way valve O-ring is fitted into the grooves, accordingly, the rear end opening of the secondary piston has a tapered ring surface and matches with a rim formed on the back face of the tapered section on the piston rod, a clearance serving as a gas path is left between the matching surfaces, male threads are arranged at the forefront of the main body, into which a piston gland nut is screwed, a diameter of the piston gland nut is larger than a minimum diameter of the tapered ring surface of the secondary piston, and is smaller than a diameter of the recessed groove fluted within the secondary piston, so that a clearance serving as a gas path is left between an external surface of the piston gland nut and an internal surface of the secondary piston, an air channel is grooved on a compressing surface of the piston gland nut, the secondary piston together with the main body of the piston rod, the one-way valve O-ring, and the piston gland nut consists of the second non-returning control valve.

8. The turn-back coaxial gas pressurizing pump according to claim 7, wherein, the piston rod is hollow to form a gas path for communicating with the pressure output gas line, the front end of the piston rod is configured into a flute, the non-returning air-out valve is provided in the flute, and the non-returning air-out valve communicates with the gas path built in the secondary compression chamber and the piston rod.

9. The turn-back coaxial gas pressurizing pump according to claim 8, wherein external surfaces of the primary piston and the secondary piston have annular grooves respectively, and guide rings are fitted into the annular grooves.

10. The turn-back coaxial gas pressurizing pump according to claim 8, wherein, the secondary cylinder extends from an open end of the primary cylinder and extends through the air pump bonnet, and a pressure bar guide ring is provided in clearance fit with a fitting portion between the air pump bonnet and the secondary cylinder.

11. The turn-back coaxial gas pressurizing pump according to claim 8, wherein, the non-returning intake valve is provided in a continuous groove placed on a bottom wall of the primary cylinder, an output side of the non-returning intake valve communicates with the primary compression chamber of the primary cylinder, an intake side of the non-returning intake valve communicates with atmosphere.

12. The turn-back coaxial gas pressurizing pump according to claim 11, wherein, a sealing plug is provided at the end of the continuous groove, the non-returning intake valve is provided in a groove fluted on a front end of the sealing plug, a plurality of seal rings are provided in annular grooves on an outer cylindrical surface of the sealing plug, and the sealing plug is screwed to the continuous groove on the bottom wall.

13. The turn-back coaxial gas pressurizing pump according to claim 8, wherein, a first annular notch is fluted on a contact of a front end surface of the primary piston and an internal surface of the primary cylinder, and a first seal assembly is fitted into the first annular notch; a second annular notch is fluted on a contact of a front end surface of the secondary piston and an internal surface of the secondary cylinder, and a second seal assembly is fitted into the second annular notch; the first and second seal assemblies each consists of an elastic seal ring and a wear-resistant ring gasket, the ring gasket having a recessed annular groove, and the elastic seal ring is placed between the annular groove and the respective first and second annular notches of the respective primary and secondary pistons.

14. The turn-back coaxial gas pressurizing pump according to claim 7, wherein, a first annular notch is fluted on a contact of a front end surface of the primary piston and an internal surface of the primary cylinder, and a first seal assembly is fitted into the first annular notch; a second annular notch is fluted on a contact of a front end surface of the secondary piston and an internal surface of the secondary cylinder, and a second seal assembly is fitted into the second annular notch; the first and second seal assemblies each consists of an elastic seal ring and a wear-resistant ring gasket, the ring gasket having a recessed annular groove, and the elastic seal ring is placed between the annular groove and the respective first and second annular notches of the respective primary and secondary pistons.

15. The turn-back coaxial gas pressurizing pump according to claim 1, wherein, a first annular notch is fluted on a contact of a front end surface of the primary piston and an internal surface of the primary cylinder, and a first seal assembly is fitted into the first annular notch; a second annular notch is fluted on a contact of a front end surface of the secondary piston and an internal surface of the secondary cylinder, and a second seal assembly is fitted into the second annular notch; the first and second seal assemblies each consists of an elastic seal ring and a wear-resistant ring gasket, the ring gasket having a recessed annular groove, and the elastic seal ring is placed between the annular groove and the respective first and second annular notches of the respective primary and secondary pistons.

16. A turn-back coaxial gas pressurizing pump comprising, a primary cylinder, a primary piston provided in the primary cylinder, a secondary cylinder serving as a rod of the primary piston, a pressure bar fixed to the secondary cylinder, and an air pump bonnet covering an open end of the primary cylinder;

wherein a secondary piston and a piston rod are provided in the secondary cylinder, and the primary cylinder, the secondary cylinder, and the piston rod arranged coaxially, a rear end of the piston rod extends through the primary piston and is fixed on a bottom of the primary cylinder, a first non-returning adaptive valve is placed between the piston rod and the primary piston, a primary compression chamber formed by a front end of the primary piston is provided in the primary cylinder and communicates with external air via a non-returning intake valve, a secondary compression chamber formed by a front end of the secondary piston is provided in the secondary cylinder and communicates with a pressure output gas line via a non-returning air out valve, the primary compression chamber communicates with a transition chamber formed by a rear end of the secondary piston which is provided in the secondary cylinder via the first non-returning adaptive valve in a one-way manner, and the transition chamber communicates with the secondary compression chamber via a second non-returning control valve in a one-way manner, wherein, a recessed groove is fluted by the rear end of the secondary piston, and a front portion of the piston rod is fitted into the recessed groove, a front section of a main body of the piston rod is a tapered section whose front end is a male cone with annular grooves on its conical surface, a one-way valve O-ring is fitted into the grooves, accordingly, the rear end opening of the secondary piston has a tapered ring surface and matches with a rim formed on the back face of the tapered section on the piston rod, a clearance serving as a gas path is left between the matching surfaces, male threads are arranged at the forefront of the main body, into which a piston gland nut is screwed, a diameter of the piston gland nut is larger than a minimum diameter of the tapered ring surface of the secondary piston, and is smaller than a diameter of the recessed groove fluted within the secondary piston, so that a clearance serving as a gas path is left between an external surface of the piston gland nut and an internal surface of the secondary piston, an air channel is grooved on a compressing surface of the piston gland nut, the secondary piston together with the main body of the piston rod, the one-way valve O-ring, and the piston gland nut consists of the second non-returning control valve.

17. The turn-back coaxial gas pressurizing pump according to claim 16, wherein, the piston rod is hollow to form a gas path for communicating with the pressure output gas line, the front end of the piston rod is configured into a flute, the non-returning air-out valve is provided in the flute, and the non-returning air-out valve communicates with the gas path built in the secondary compression chamber and the piston rod.

18. The turn-back coaxial gas pressurizing pump according to claim 17, wherein, a first annular notch is fluted on a contact of a front end surface of the primary piston and an internal surface of the primary cylinder, and a first seal assembly is fitted into the first annular notch; a second annular notch is fluted on a contact of a front end surface of the secondary piston and an internal surface of the secondary cylinder, and a second seal assembly is fitted into the second annular notch; the first and second seal assemblies each consists of an elastic seal ring and a wear-resistant ring gasket, the ring gasket having a recessed annular groove, and the elastic seal ring is placed between the annular groove and the respective first and second annular notches of the respective primary and secondary pistons.

19. The turn-back coaxial gas pressurizing pump according to claim 16, wherein, a first annular notch is fluted on a contact of a front end surface of the primary piston and an internal surface of the primary cylinder, and a first seal assembly is fitted into the first annular notch; a second annular notch is fluted on a contact of a front end surface of the secondary piston and an internal surface of the secondary cylinder, and a second seal assembly is fitted into the second annular notch; the first and second seal assemblies each consists of an elastic seal ring and a wear-resistant ring gasket, the ring gasket having a recessed annular groove, and the elastic seal ring is placed between the annular groove and the respective first and second annular notches of the respective primary and secondary pistons.

20. The turn-back coaxial gas pressurizing pump according to claim 16, wherein, external surfaces of the primary piston and the secondary piston have annular grooves respectively, and guide rings are fitted into the annular grooves.

21. The turn-back coaxial gas pressurizing pump according to claim 16, wherein, the secondary cylinder extends from an open end of the primary cylinder and extends through the air pump bonnet, and a pressure bar guide ring is provided in clearance fit with a fitting portion between the air pump bonnet and the secondary cylinder.

22. A gas pressurizing method, which uses the turn-back coaxial gas pressurizing pump as set forth in claim 16, comprising the following steps:

controlling the pressure bar to drive the secondary cylinder and the primary piston to move towards a gas suction direction of the primary cylinder, so that the first non-returning adaptive valve is closed and the non-returning intake valve is opened to take air into the primary compression chamber, and the second non-returning control valve is opened to allow the gas in the transition chamber to enter into the secondary compression chamber, and controlling the pressure bar to drive the secondary cylinder and primary piston to move towards a gas discharging direction of the secondary cylinder, so that the non-returning intake valve is closed and the first non-returning adaptive valve is opened to discharge pressurized gas from the primary compression chamber into the transition chamber, and at the same time the second non-returning control valve is closed, the non-returning air-out valve is opened, and the compressed high pressure gas in the secondary compression chamber is discharged into the pressure output gas line.

* * * * *